US012716150B2

(12) United States Patent
Kosui et al.

(10) Patent No.: US 12,716,150 B2
(45) Date of Patent: Aug. 25, 2026

(54) KNITTED ARTICLE

(71) Applicants: SHIMA SEIKI MFG., LTD., Wakayama (JP); Toray Industries, Inc., Tokyo (JP)

(72) Inventors: Tatsuya Kosui, Wakayama (JP); Yusuke Shimizu, Wakayama (JP); Kazunori Shibata, Otsu (JP); Hirotaka Hananouchi, Otsu (JP)

(73) Assignees: SHIMA SEIKI MFG., LTD, Wakayama (JP); TORAY INDUSTRIES, INC., Tokyo (JP)

( * ) Notice: Subject to any disclaimer, the term of this patent is extended or adjusted under 35 U.S.C. 154(b) by 0 days.

(21) Appl. No.: 19/155,636

(22) PCT Filed: Mar. 18, 2024

(86) PCT No.: PCT/JP2024/010596
§ 371 (c)(1),
(2) Date: Aug. 12, 2025

(87) PCT Pub. No.: WO2024/195775
PCT Pub. Date: Sep. 26, 2024

(65) Prior Publication Data

US 2026/0234844 A1 Aug. 13, 2026

(30) Foreign Application Priority Data

Mar. 22, 2023 (JP) ..... 2023-045936

(51) Int. Cl.
*D04B 1/16* (2006.01)

(52) U.S. Cl.
CPC ..... *D04B 1/16* (2013.01); *D10B 2331/04* (2013.01); *D10B 2403/0114* (2013.01)

(58) Field of Classification Search
CPC ... D04B 1/12; D04B 1/14; D04B 1/16; D04B 1/18; D04B 1/20; D04B 7/16; D04B 21/16; D04B 21/18
See application file for complete search history.

(56) References Cited

U.S. PATENT DOCUMENTS 3,041,861 A * 7/1962 Kasey, Jr. et al. ..... D04B 21/16 66/195
3,403,537 A * 10/1968 Gajjar ..... D04B 21/16 66/195

(Continued)

FOREIGN PATENT DOCUMENTS

CN 121079460 A * 12/2025 ..... D04B 1/14
JP 3015174 U 6/1995

(Continued)

OTHER PUBLICATIONS

Notification of Transmittal of Translation of the International Preliminary Report on Patentability (Forms PCT/IB/338 and PCT/IB/373) and an English Translations of the Written Opinion of the International Searching Authority (Form PCT/ISA/237) issued Oct. 2, 2025, by the International Bureau of WIPO in corresponding International Application No. PCT/JP2024/010596. (5 pages).

(Continued)

*Primary Examiner* — Danny Worrell
(74) *Attorney, Agent, or Firm* — Buchanan Ingersoll & Rooney PC

(57) ABSTRACT

Provided is a knitted article which is excellent in abrasion resistance, is less prone to yarn breakage and weight loss due to abrasion, and is less liable to undergo discoloration or fading. The knitted article is a knitted article comprising a first filament and a second filament interknitted together. A fineness of the second filament is smaller than a fineness of the first filament. In top view, a proportion of the second filament per unit area on one surface is from 10% to 50%.

(Continued)

In a cross section taken along a thickness direction, among all the filaments constituting a cutting line A parallel to the knitted article surface at a depth of 20 μm in the thickness direction from the knitted article surface, the first filament is 90% or more.

5 Claims, 7 Drawing Sheets

(56) References Cited

U.S. PATENT DOCUMENTS 5,687,587 A * 11/1997 Michel ..... D04B 1/18 66/196
7,797,968 B2 * 9/2010 Chuang ..... D04B 1/18 66/198
9,255,351 B2 * 2/2016 Menczywor ..... D04B 9/12
2012/0122364 A1 5/2012 Menczywor
2021/0115601 A1 4/2021 Yanagita

FOREIGN PATENT DOCUMENTS

JP 2006265746 A 10/2006
JP 2022131455 A 9/2022
WO 2018180801 A1 10/2018

OTHER PUBLICATIONS

International Search Report (PCT/ISA/210) with translation and Written Opinion (PCT/ISA/237) mailed on Jun. 18, 2024, by the Japan Patent Office as the International Searching Authority for International Application No. PCT/JP2024/010596. (9 pages).

* cited by examiner

KNITTED ARTICLE

CROSS REFERENCE TO RELATED APPLICATIONS

This application is the U.S. National Phase of PCT/JP2024/010596, filed Mar. 18, 2024, which claims priority to Japanese Patent Application No. 2023-045936, filed Mar. 22, 2023, the disclosures of these applications being incorporated herein by reference in their entireties for all purposes.

FIELD OF THE INVENTION

The present invention relates to a knitted article. More specifically, the present invention relates to a knitted article which is excellent in abrasion resistance, less prone to yarn breakage and weight loss due to abrasion, and less liable to undergo discoloration or fading.

BACKGROUND OF THE INVENTION

Conventionally, in fields such as apparel, various knitted articles have been studied to achieve both a good feel and a high strength (see, for example, Patent Document 1).

Patent Document

Patent Document 1: Japanese Utility Model Registration No. 3015174

SUMMARY OF THE INVENTION

However, when the knitted fabric described in Patent Document 1 is repeatedly used, the constituent filaments of the fabric may break due to abrasion, the fabric may become partially thin due to weight loss, or the fabric may undergo whitish discoloration due to accumulation of fiber debris.

The present invention has been made in view of such problems in the conventional art and has an object to provide a knitted article which is excellent in abrasion resistance, less prone to yarn breakage and weight loss due to abrasion, and less liable to undergo discoloration or fading.

A knitted article according to an aspect of the present invention that solves the above-mentioned problems is a knitted article comprising a first filament and a second filament interknitted together. A fineness of the second filament is smaller than a fineness of the first filament. In top view, a proportion of the second filament per unit area on one surface is from 10% to 50%. In a cross section taken along a thickness direction, among all the filaments constituting a cutting line A parallel to a knitted article surface at a depth of 20 μm in the thickness direction from the knitted article surface, the first filament is 90% or more.

DETAILED DESCRIPTION OF EMBODIMENTS OF THE INVENTION

<Knitted Article>

Figure 1:
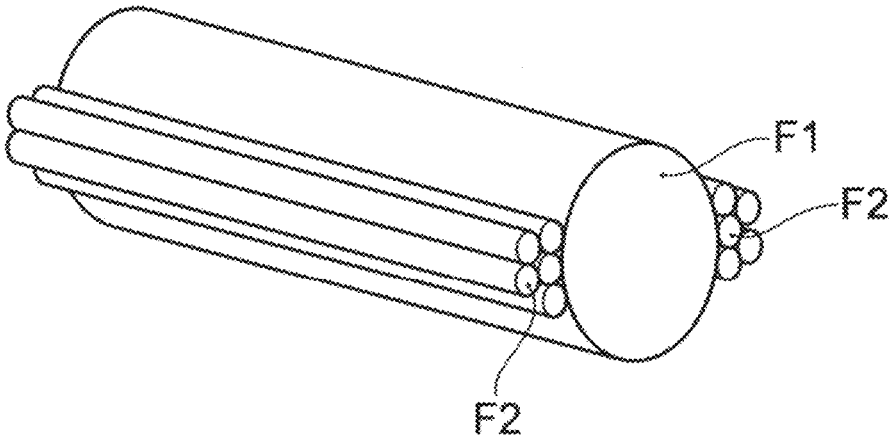
FIG. 1 is an explanatory schematic view for illustrating a configuration of a knitted article according to one embodiment of the present invention.

A knitted article of this embodiment is a knitted article comprising a first filament and a second filament interknitted together. A fineness of the second filament is smaller than a fineness of the first filament. In top view, a proportion of the second filament per unit area on one surface is from 10% to 50%. In a cross section taken along a thickness direction, among all the filaments constituting a cutting line A parallel to a knitted article surface at a depth of 20 μm in the thickness direction from the knitted article surface, the first filament is 90% or more. In the following, each of those features is described.

(First Filament and Second Filament)

The knitted article of this embodiment is a knitted article comprising a first filament and a second filament interknitted together. A fineness of the second filament is smaller than a fineness of the first filament. Moreover, the first filament and the second filament may be a monofilament or may be a multifilament. That is, when the first filament is a monofilament, the second filament may be a monofilament having a fineness smaller than that of the first filament, or may be a multifilament. Moreover, when the first filament is a multifilament, the second filament may be a monofilament having a fineness smaller than that of the first filament, or may be a multifilament. In the knitted article of this embodiment, the first filament is preferably a monofilament, and the second filament is preferably a multifilament having a fineness smaller than that of the first filament. In the following, in this embodiment, as a suitable example, illustration is given of a case in which the first filament is a monofilament and the second filament is a multifilament having a fineness smaller than that of the first filament.

The first filament is not particularly limited. As an example, the first filament is a monofilament made of a polyester-based elastomer, a polyurethane elastomer, or the like.

The polyester-based elastomer is not particularly limited. As an example, the polyester-based elastomer is a thermoplastic rubber elastic body having a polyester-based structure, such as polyethylene terephthalate (PET), polytrimethylene terephthalate (PTT), or polybutylene terephthalate (PBT). A fiber containing the polyester-based elastomer may be a fiber made of the polyester-based elastomer alone or may be a composite fiber made of a polyester elastomer and polyester. The composite fiber is, for example, a fiber with a core-sheath structure or a fiber with a side-by-side structure. Examples of the polyester used together with the polyester-based elastomer include polyethylene terephthalate, polytrimethylene terephthalate, and polybutylene terephthalate. Moreover, when the fiber containing the polyester-based elastomer is a fiber with a core-sheath structure, the fiber with a core-sheath structure may be a fiber having a core portion made of a polyester-based elastomer and a sheath portion made of polyester, or may be a fiber having a core portion made of polyester and a sheath portion made of a polyester-based elastomer.

The first filament is preferably made of a polyester-based elastomer. With such a configuration, the knitted article is more excellent in stretchability and chemical resistance.

It is required that the fineness of the first filament be larger than the fineness of the second filament, which will be described later. As an example, the fineness of the first filament (monofilament) is preferably 100 dtex or more, more preferably 300 dtex or more. Moreover, the fineness of the first filament (monofilament) is preferably 1,500 dtex or less, more preferably 1,000 dtex or less. When the fineness of the first filament falls within the above-mentioned ranges, the knitted article is excellent in abrasion resistance. In this embodiment, the fineness can be calculated by taking 25 first filaments from the knitted article, loosening them, and measuring their length (mm) and mass (mg) in accordance with JIS L 1018 (2010) 8.7.1.

The second filament is not particularly limited. As an example, the second filament is a multifilament made of a polyester (PET) resin, a polypropylene (PP) resin, a polyethylene (PE) resin, a polyphenylene sulfide (PPS) resin, a polyethylene naphthalate (PEN) resin, a liquid crystal polymer (LCP) resin, a polybutylene terephthalate resin, a polyphenylene sulfide resin, a polyketone resin, a polyamide resin, or mixtures thereof. The multifilament may be a textured yarn that has undergone processing such as false twisting, or may be a spun yarn.

A single yarn fineness of the second filament (multifilament) is not particularly limited. As an example, the single yarn fineness of the second filament (multifilament) is preferably 0.5 dtex or more, more preferably 1 dtex or more. Moreover, the single yarn fineness of the second filament (multifilament) is preferably 50 dtex or less, more preferably 20 dtex or less. When the single yarn fineness of the second filament falls within the above-mentioned ranges, the knitted article can suppress glare and a rough texture, and can exhibit an excellent texture and luster. In this embodiment, the single yarn fineness can be calculated by dividing a total fineness, which will be described later, by the number of filaments. Moreover, the number of filaments can be calculated according to the method in JIS L 1013 (1999) 8.4.

It is required that the fineness (total fineness) of the second filament (multifilament) be smaller than the fineness of the first filament described above. As an example, the total fineness of the second filament (multifilament) is preferably 25 dtex or more, more preferably 100 dtex or more. Moreover, the total fineness of the second filament (multifilament) is preferably 1,000 dtex or less, more preferably 500 dtex or less. When the total fineness of the second filament falls within the above-mentioned ranges, the knitted article can suppress glare and a rough texture, and can exhibit an excellent texture and luster. In this embodiment, the total fineness can be calculated by taking 25 second filaments from the knitted article, loosening them, and measuring their length (mm) and mass (mg) in accordance with JIS L 1018 (2010) 8.7.1.

Returning to the overall description of the knitted article, the knitted article of this embodiment is a knitted article comprising the first filament and the second filament interknitted together as described above. A knitting structure constituting the knitted fabric is not particularly limited. As an example, the knitting structure includes plating knitting and held-together yarn knitting, which can be obtained using a knitting machine manufactured by SHIMA SEIKI MFG., LTD. The knitted article of this embodiment can be suitably produced by performing tuck knitting, which incorporates a tuck structure into plating knitting.

A bending hardness of the first filament is preferably at least twice, more preferably at least four times, a bending hardness of the second filament. When the relationship between the bending hardness of the first filament and the bending hardness of the second filament falls within the above-mentioned ranges, the knitted article is excellent in abrasion resistance while keeping adequate softness. Moreover, the bending hardness of the first filament is preferably 500 mN or less, more preferably 250 mN or less. When the bending hardness of the first filament falls within the above-mentioned ranges, knitting using a general-purpose knitting machine is possible. Further, the bending hardness of the first filament is preferably 50 mN or more, more preferably 100 mN or more. When the bending hardness of the first filament falls within the above-mentioned ranges, the load resistance is good at the time of applying the knitted article to a seat. Moreover, the bending stiffness of the second filament is preferably 500 mN or less, more preferably 250 mN or less. When the bending stiffness of the second filament falls within the above-mentioned ranges, knitting using a general-purpose knitting machine is possible. In this embodiment, the bending hardness can be calculated using a method described later.

Figure 2:
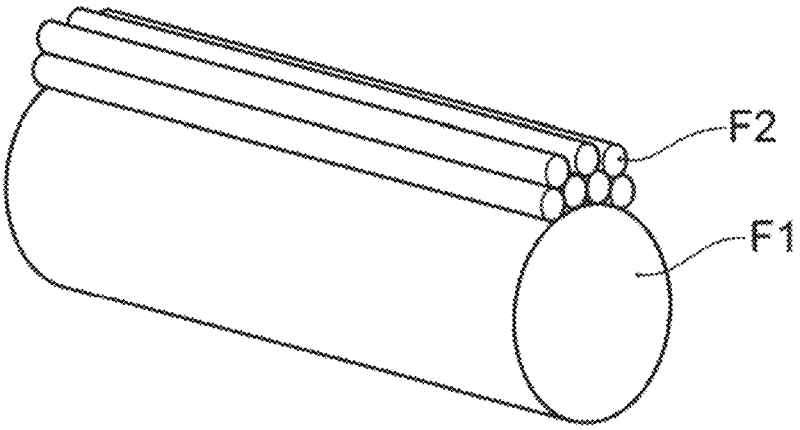
FIG. 2 is an explanatory schematic view for illustrating a configuration of a conventional knitted article.
Figure 3:
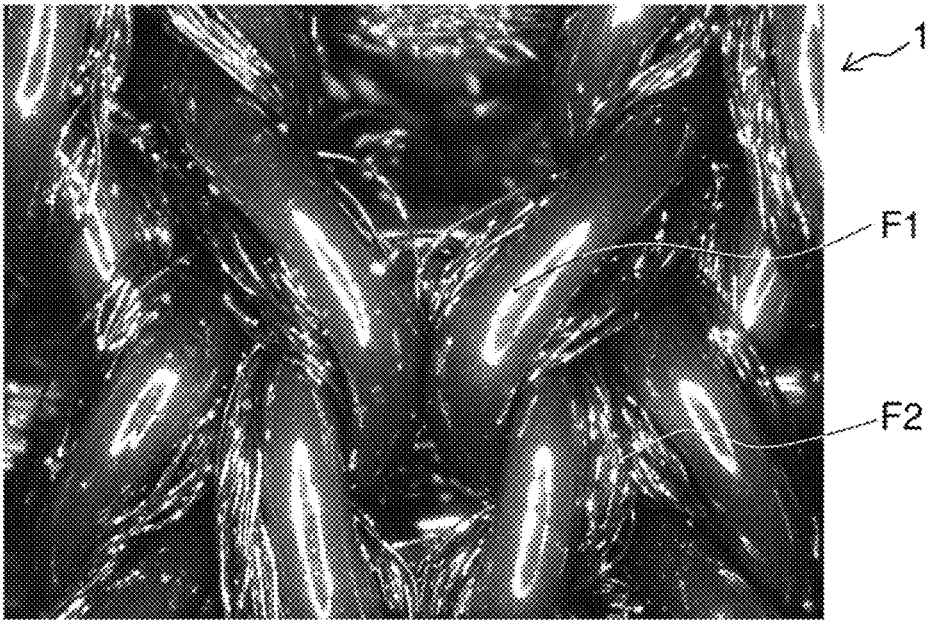
FIG. 3 is an optical micrograph in top view of the knitted article according to one embodiment of the present invention.
Figure 4:
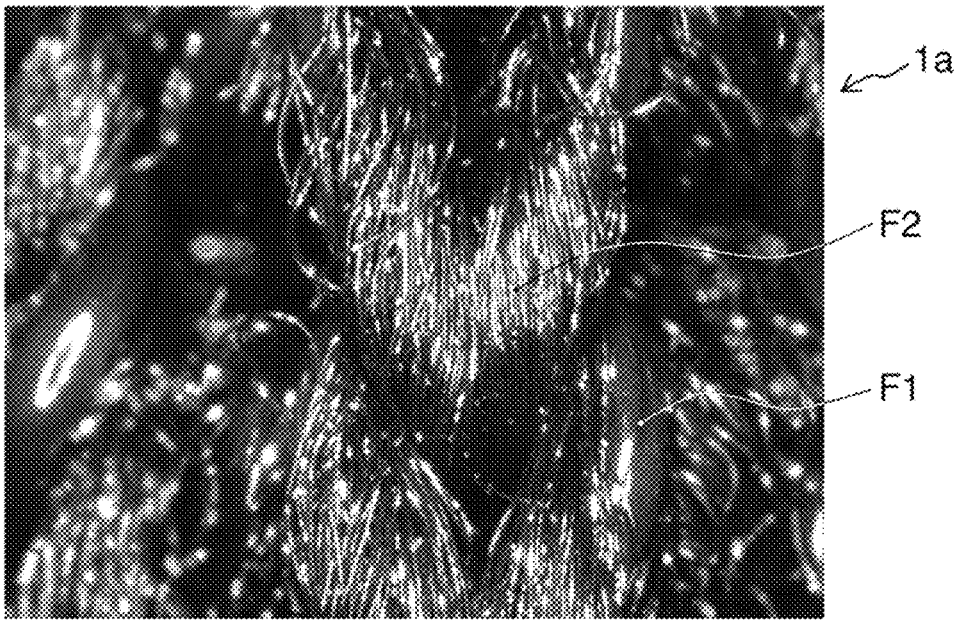
FIG. 4 is an optical micrograph in top view of the conventional knitted article.

FIG. 1 is an explanatory schematic view for illustrating a configuration of a knitted article 1 of this embodiment. FIG. 2 is an explanatory schematic view for illustrating a configuration of a conventional knitted article 1*a*. FIG. 3 is an optical micrograph in top view of the knitted article 1 of this embodiment. FIG. 4 is an optical micrograph in top view of the conventional knitted article 1*a*.

Figure 6:
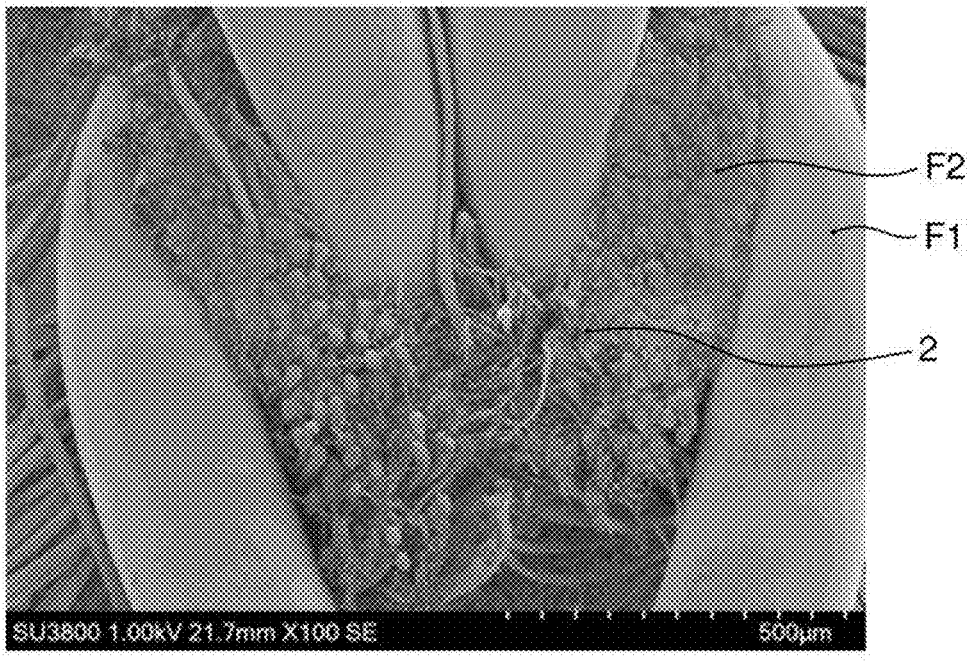
FIG. 6 is an SEM (scanning electron microscope) photograph in top view of the conventional knitted article after an abrasion resistance test.

In the conventional knitted article 1*a*, when the knitted fabric is produced, for example, by the plating knitting, as illustrated in FIG. 2, a second filament F2 is provided so as to cover a periphery of a first filament F1. In such conventional knitted article 1*a*, as shown in FIG. 4, in top view, the second filament F2 (for example, multifilament) is arranged so as to cover the first filament F1 (for example, monofilament). Thus, when the knitted article surface is abraded, the second filament F2 is subjected to friction directly and damaged, with the result that the second filament F2 (multifilament) is broken and fiber debris 2 is produced. FIG. 6 is an SEM (scanning electron microscope) photograph in top view of the conventional knitted article 1*a* after an abrasion resistance test. As shown in FIG. 6, the fiber debris 2 of the second filament F2 clogs at a part where single yarn breakage has occurred. Thus, because the fractured surface scatters light, the knitted article 1*a* is liable to undergo discoloration or fading when subjected to abrasion.

Figure 5:
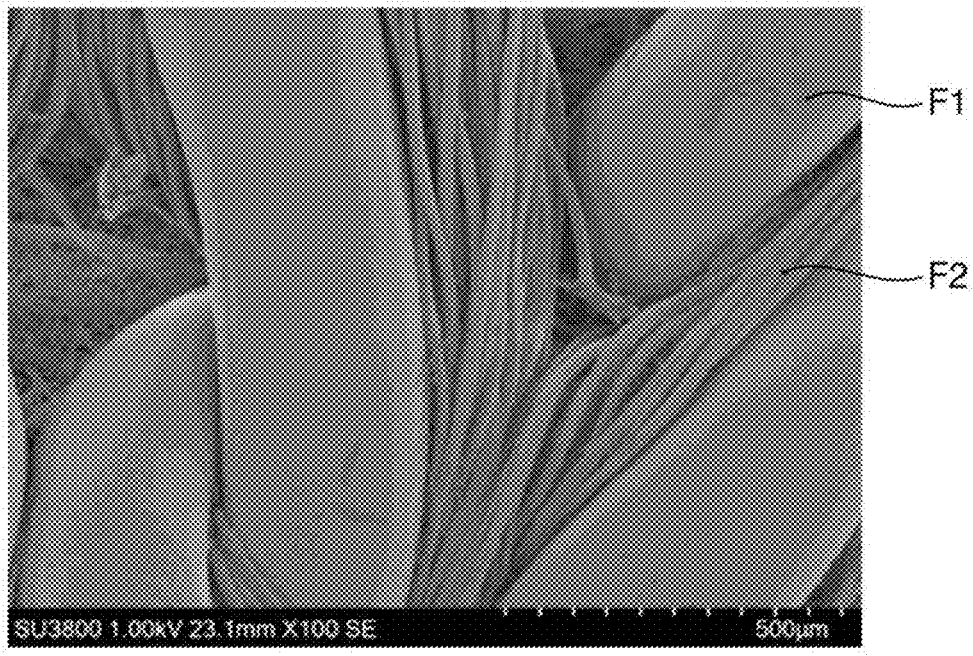
FIG. 5 is an SEM (scanning electron microscope) photograph in top view of the knitted article according to one embodiment of the present invention after an abrasion resistance test.

Meanwhile, as illustrated in FIG. 1, in the knitted article 1 of this embodiment, for example, by incorporating a tuck structure into the knitted fabric produced by the plating knitting, the second filament F2 is arranged so as to be positioned beside the first filament F1 on one surface of the knitted article 1. Specifically, in the knitted article 1 of this embodiment, the second filament F2 is shifted somewhat in a depth direction along a periphery of the first filament F1 from the knitted article surface of the knitted article 1. As a result, as shown in FIG. 3, in top view, both the first filament F1 (for example, monofilament) and the second filament F2 (multifilament) are arranged at positions where they can be observed. Moreover, in the knitted article 1 of this embodiment, as described above, the second filament F2 is shifted on the periphery of the first filament F1. Thus, the second filament F2 is either not exposed or hardly exposed on the knitted article surface. FIG. 5 is an SEM (scanning electron microscope) photograph in top view of the knitted article 1 of this embodiment after an abrasion resistance test. As shown in FIG. 5, the second filament F2 (multifilament) is less prone to single yarn breakage, and is less liable to produce fiber debris. Thus, because the fractured surface is less liable to be produced, the knitted article 1 of this embodiment is less liable to undergo discoloration or fading even when subjected to abrasion.

More specifically, in the knitted article of this embodiment, in top view, a proportion of the second filament per unit area on one surface is from 10% to 50%. The proportion of the second filament is required to be 10% or more, and is preferably 20% or more. Meanwhile, the proportion of the second filament is required to be 50% or less, and is preferably 35% or less. When the proportion of the second filament is less than 10%, the knitted article is liable to exhibit glare or luster. Meanwhile, when the proportion of the second filament is more than 50%, in the knitted article, the second filament is liable to be fractured and is liable to produce fiber debris when subjected to abrasion. As a result, the knitted article is liable to undergo discoloration or fading.

In this embodiment, as a method of calculating the proportion of the second filament per unit area in top view, for example, calculation can be made by performing image processing on an SEM photograph. Specifically, the proportion of the second filament per unit area in top view can be calculated by taking an SEM photograph with a scanning electron microscope (product name: SU-3800, seller: Hitachi High-Tech Corporation), performing binarization processing and opening processing on the SEM photograph to calculate areas of the first filament and the second filament observed in top view, and then determining a difference with the area of the first filament.

Figure 7:
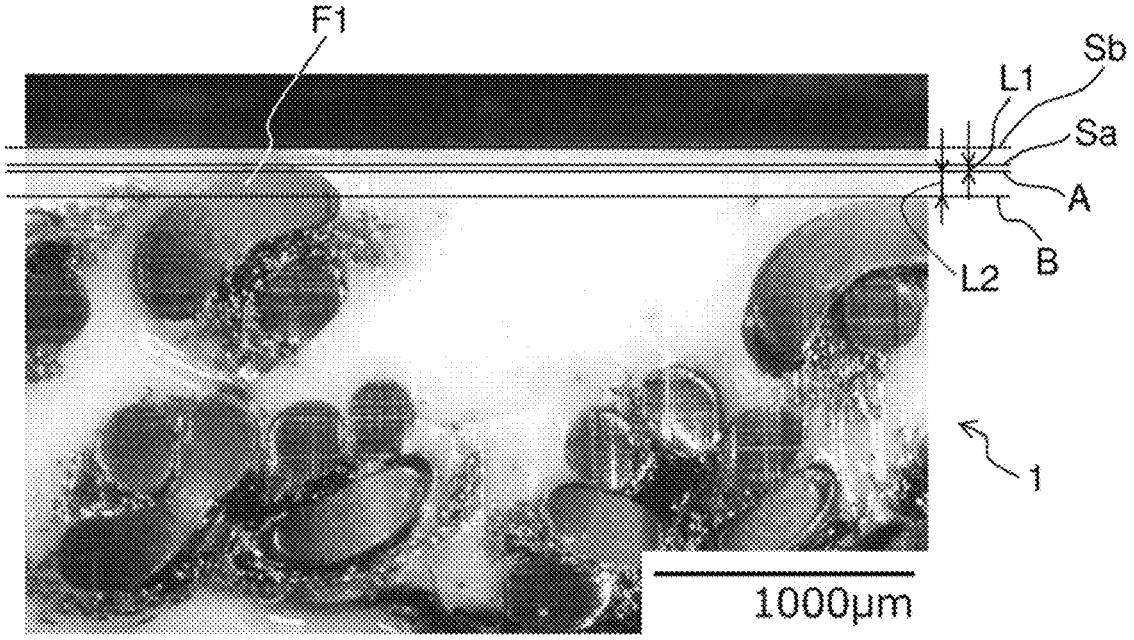
FIG. 7 is an optical micrograph of a cross section of the knitted article according to one embodiment of the present invention taken along a thickness direction.

Moreover, in the knitted article of this embodiment, in a cross section taken along a thickness direction, among all the filaments constituting a cutting line A parallel to the knitted article surface at a depth of 20 μm in the thickness direction from the knitted article surface (that is, a cutting line A in a plane direction parallel to the knitted article surface at a depth of 20 μm in the thickness direction from the knitted article surface), the first filament is 90% or more. FIG. 7 is an optical micrograph of a cross section of the knitted article of this embodiment taken along the thickness direction. Here, the knitted article of this embodiment shown in FIG. 7 is embedded and fixed with an epoxy resin, and the knitted article of this embodiment and the epoxy resin form a resin-embedded sample. Details of a production method for the resin-embedded sample is described later, and a method of specifying the knitted article surface in the cross section of the resin-embedded sample is now described. In FIG. 7, Sb represents a surface of the resin-embedded sample. When the Sb is scanned in parallel toward an interior of the resin-embedded sample in the thickness direction of the resin-embedded sample, a point of first contact with at least any one of the first filament or the second filament is defined as the knitted article surface. In addition, in FIG. 7, Sa represents the knitted article surface. From the above, the Sb and the Sa are parallel. Moreover, L1 is 20 μm, and L2 is 100 μm. The proportion of the first filament is required to be 90% or more, and is more preferably 95% or more. When the proportion of the first filament in the cutting line A is less than 90%, in the knitted article, the second filament is liable to be fractured and is liable to produce fiber debris when subjected to abrasion. As a result, the knitted article is liable to undergo discoloration or fading.

In this embodiment, as shown in FIG. 7, as a method of calculating the proportion of the first filament among all the filaments constituting the cutting line A in the cross section taken along the thickness direction, for example, calculation can be made by embedding and fixing the knitted article with an epoxy resin, cutting out the cross section with a microtome, and observing the cross section with a microscope. In this case, by mixing about 5 mass % of a white pigment (for example, titanium oxide) into the epoxy resin, the filaments constituting the knitted article and a space can be easily distinguished.

As shown in FIG. 7, in the cutting line A parallel to the knitted article surface at the depth of 20 μm in the thickness direction from the knitted article surface, the second filament F2 is hardly observed, and the first filament F1 is 90% or more. In the knitted article 1 of this embodiment, the second filament F2 is arranged more on a center side in the thickness direction than the second filament F2, rather than covering first filament F1. As a result, in the knitted article 1, even when the knitted article surface is somewhat abraded due to friction, the second filament F2 is less prone to yarn breakage and is less liable to produce fiber debris. As a result, the knitted article 1 is less prone to weight loss, and is less liable to undergo discoloration or fading.

The knitted article of this embodiment can incorporate tuck knitting. The tuck knitting is a knitting method where, when supplying a knitting yarn to a knitting needle that holds a stitch, the knitting yarn is held by the knitting needle together with a previously formed stitch without forming a new stitch, and it is also possible to subsequently form regular stitches. When the tuck knitting is applied in simultaneously knitting a front knitted fabric and a back knitted fabric to make a two-layered knitted article, by tucking the knitting yarn to the other knitted fabric while one knitted fabric is being knitted, the front and back knitted fabrics can be connected while keeping adequate softness.

Moreover, the knitted article is easily knitted into a structure where, as illustrated in FIG. 1, the second filament F2 is arranged beside the first filament F1. This is achieved by performing plating knitting using filaments where the bending stiffness of the first filament is at least twice the bending stiffness of the second filament, and applying the tuck knitting such that the tuck knitting accounts for 10% or more of the stitches per unit area. More specifically, with the bending stiffness of the first filament being at least twice the bending stiffness of the second filament, in the knitted article, at the time of knitting, more easily bendable stitches of the second filament are more prone to deformation than the less easily bendable (that is, stiffer) stitches of the first filament. In addition, with the tuck knitting being applied such that the tuck knitting accounts for 10% or more of the stitches per unit area, in the knitted article, the second filament that is easily bent is incorporated into the connection part between the front knitted fabric and the back knitted fabric. As a result, the knitted article can be knitted such that the second filament F2 is not arranged directly above the first filament F1 as illustrated in FIG. 2 but is arranged beside the first filament F1 as illustrated in FIG. 1. From the viewpoint as described above, the tuck knitting preferably accounts for 13% or more of the stitches per unit area.

It is preferable that the tuck structure is not two consecutive structures in a wale direction (the length direction of the knitted fabric). In order to create two consecutive structures in the wale direction, it is required to hold three filaments on the knitting needle of the knitting machine. For this reason, the knitting needle may be subjected to stress and break. That is, it is preferable that the next structure after the tuck structure in the wale direction is a knit. Moreover, the tuck structure cannot be consecutive in a course direction (the width direction of the knitted fabric). Thus, a proportion of the tuck knitting with respect to the stitches per unit area is preferably 50% or less.

Moreover, in the knitted article of this embodiment, in the cross section taken along the thickness direction, among all the filaments constituting the cutting line B parallel to the knitted article surface at a position deeper by 100 μm in the thickness direction from the above-mentioned cutting line A, the second filament is preferably 15% or more, more preferably 20% or more. Further, the proportion of the second filament among all the filaments constituting the cutting line B is preferably 50% or less, more preferably 40% or less. That is, as shown in FIG. 7, in the knitted article 1, arrangement is made such that a large amount of the first filament F1 is provided in a region close to the knitted article surface (cutting line A), and a larger amount of the second filament F2 is provided in a deeper region (cutting line B), as compared to the region close to the knitted article surface (cutting line A). With such a configuration, in the knitted article 1, even when the knitted article surface is somewhat abraded due to friction, the second filament F2 is less prone to yarn breakage and is less liable to produce fiber debris. As a result, the knitted article 1 is less prone to weight loss, and is less liable to undergo discoloration or fading.

In this embodiment, the abrasion resistance test may employ the JIS L 1096 Method E (Martindale method). The abrasion resistance test (Martindale abrasion test) is a method for evaluating the abrasion strength of a knitted article, in which a test piece (the knitted article of this embodiment) is mounted on a sample holder of a Martindale abrasion tester, a standard abrasive cloth for the Martindale tester (ABRASIVE CLOTH 1575W (manufactured by J.H.Heal)) is mounted on an abrasion table of the abrasion tester, the sample holder is placed on top, and a pressing load (12.0±0.3 kPa) is applied to rub in multiple directions. In this embodiment, the number of rubbing cycles is 10,000. Moreover, this test was used to evaluate not only the abrasion resistance of the knitted article but also the discoloration or fading due to abrasion after the test and the change in weight before and after the test.

Figure 8:
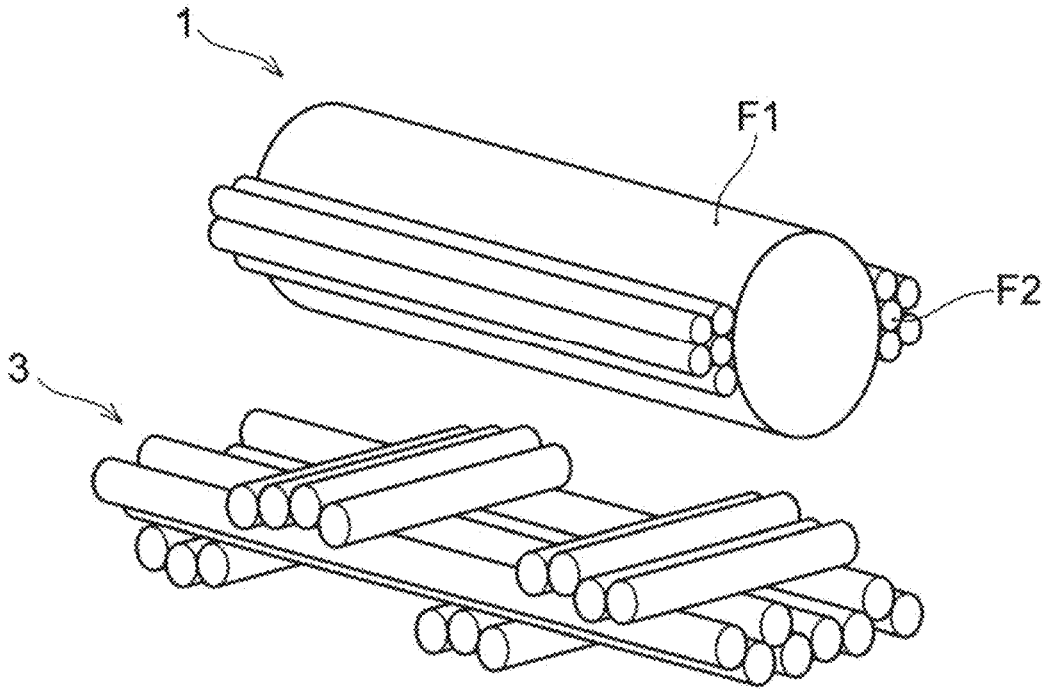
FIG. 8 is an explanatory schematic view for illustrating a state of the knitted article and a rubbing cloth before the abrasion resistance test.
Figure 9:
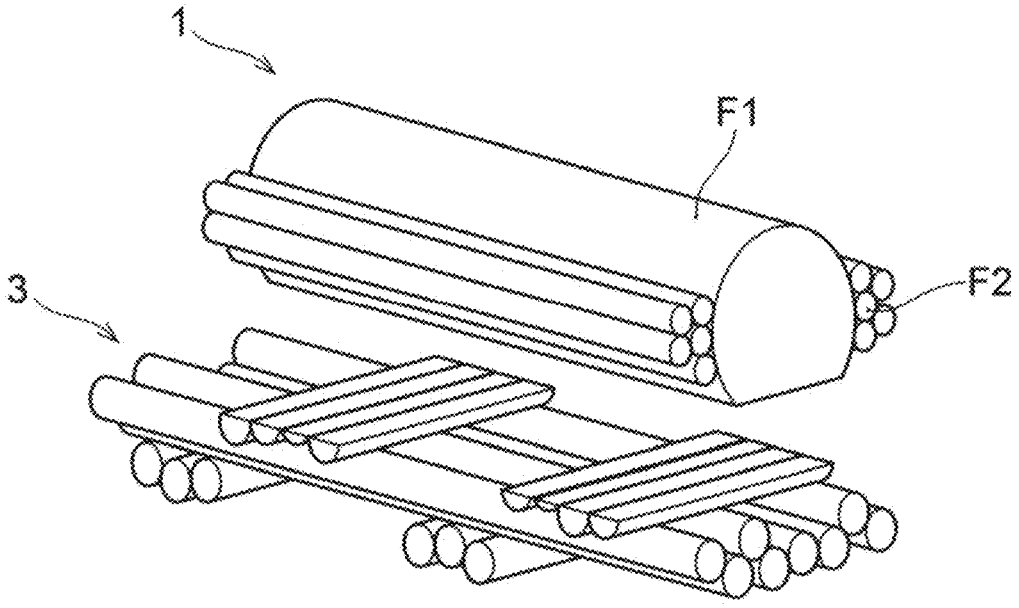
FIG. 9 is an explanatory schematic view for illustrating a state of the knitted article and the rubbing cloth after the abrasion resistance test.

FIG. 8 is an explanatory schematic view for illustrating a state of the knitted article 1 and the rubbing cloth 3 before the abrasion resistance test. FIG. 9 is an explanatory schematic view for illustrating a state of the knitted article 1 and the rubbing cloth 3 after the abrasion resistance test. As illustrated in FIG. 8 and FIG. 9, in the knitted article 1 of this embodiment, when the friction resistance test is performed, a surface of the first filament F1 and a surface of the abrasive cloth 3 are somewhat abraded. Meanwhile, when the abrasion resistance test is performed, the second filament F2 is less likely to be in direct contact with the abrasive cloth 3 and is less liable to be abraded. Thus, the second filament F2 is less prone to yarn breakage and is less liable to produce fiber debris. As a result, the knitted article 1 is less prone to weight loss, and is less liable to undergo discoloration or fading.

As described above, according to this embodiment, in the knitted article, in top view, a proportion of the second filament is from 10% to 50%. With such a configuration, the knitted article can exhibit an excellent texture and luster. Moreover, in the knitted article, in the cross section taken along the thickness direction, among all the filaments constituting the cutting line A parallel to the knitted article surface at the depth of 20 μm in the thickness direction from the knitted article surface, the first filament is 90% or more. With such a configuration, even when the knitted article surface is somewhat abraded due to friction, the knitted article is less prone to yarn breakage. As a result, the knitted article is less prone to weight loss. Moreover, the knitted article is less liable to produce fiber debris and thus less prone to accumulation of fiber debris, and hence is less liable to undergo discoloration or fading.

Applications of the knitted article of this embodiment are not particularly limited. For the knitted article of this embodiment, planar elastic properties and design thereof can be easily changed by modifying the yarn composition or knitting structure. Thus, the knitted article of this embodiment can be used in various fields such as various apparel, sports/outdoor, clothing, automotive, aviation, and industrial materials. In particular, by being knitted seamlessly, the knitted article can be suitably used, for example, as vehicle seats or the like, in which the main parts are made of a three-dimensional knitted fabric in place of urethane foam.

In the above, one embodiment of the present invention has been described. The present invention is not especially limited to the embodiment described above. The embodiment described above mainly describes the invention having the following configuration.

(1) A knitted article comprising a first filament and a second filament interknitted together, wherein a fineness of the second filament is smaller than a fineness of the first filament, wherein, in top view, a proportion of the second filament per unit area on one surface is from 10% to 50%, and wherein, in a cross section taken along a thickness direction, among all the filaments constituting a cutting line A parallel to the knitted article surface at a depth of 20 μm in the thickness direction from the knitted article surface, the first filament is 90% or more.

According to such a configuration, in the knitted article, in top view, the proportion of the second filament is from 10% to 50%. Accordingly, the knitted article can exhibit an excellent texture and luster. Moreover, in the knitted article, in the cross section taken along the thickness direction, among all the filaments constituting the cutting line A at the depth of 20 μm in the thickness direction from the knitted article surface, the first filament is 90% or more. Accordingly, even when the knitted article surface is somewhat abraded due to friction, the knitted article is less prone to yarn breakage. As a result, the knitted article is less prone to weight loss. Moreover, the knitted article is less liable to produce fiber debris and thus is less prone to accumulation of fiber debris, and hence is less liable to undergo discoloration or fading.

(2) The knitted article according to the item (1), wherein the first filament is a monofilament, and wherein the second filament is a multifilament.

According to such a configuration, the knitted article includes a monofilament. Thus, the knitted article is excellent in abrasion resistance. Moreover, the knitted article includes a multifilament such that, in top view, the multifilament per unit area on one surface is from 10% to 50%. Thus, glare and a rough texture is further suppressed, and hence the knitted article can exhibit more excellent texture and luster. Further, in the knitted article, in the cross section taken along the thickness direction, among all the filaments constituting the cutting line A at the depth of 20 μm in the thickness direction from the knitted article surface, the monofilament is 90% or more. That is, in the knitted article, a large amount of the monofilament is provided in a region close to the knitted article surface, and the multifilament is arranged in a deeper region. With such a configuration, in the knitted article, even when the knitted article surface is somewhat abraded due to friction, the multifilament is less prone to yarn breakage and is less liable to produce fiber debris. As a result, the knitted article is less prone to weight loss, and is less liable to undergo discoloration or fading.

(3) The knitted article according to the item (1) or (2), wherein, in the cross section taken along the thickness direction, among all the filaments constituting a cutting line B parallel to the knitted article surface at a position deeper by 100 μm in the thickness direction from the cutting line A, the second filament is from 15% to 50%.

According to such a configuration, in the knitted article, in the cross section taken along the thickness direction, among all the filaments constituting the cutting line A parallel to the knitted article surface at the depth of 20 μm in the thickness direction from the knitted article surface, the first filament is 90% or more. Moreover, in the knitted article, among all the filaments constituting the cutting line B parallel to the knitted article surface at the position deeper by 100 μm in the thickness direction from the cutting line A, the second filament is from 15% to 50%. That is, in the knitted article, arrangement is made such that a large amount of the first filament is provided in the region close to the knitted article surface (cutting line A), and an increased amount of the second filament is provided in a deeper region (cutting line B). With such a configuration, in the knitted article, even when the knitted article surface is somewhat abraded due to friction, the second filament is less prone to yarn breakage and is less liable to produce fiber debris. As a result, the knitted article is less prone to weight loss, and is less liable to undergo discoloration or fading.

(4) The knitted article according to any one of the items (1) to (3), wherein, in the cross section of the knitted article taken along the thickness direction, among all the filaments constituting the cutting line A parallel to the knitted article surface at the depth of 20 μm in the thickness direction from the knitted article surface, in a surface in which the first filament accounts for 90% or more, tuck knitting accounts for 10% or more of stitches per unit area, and wherein a bending hardness of the first filament is at least twice a bending hardness of the second filament.

According to such a configuration, in the knitted article, the front and back knitted fabrics can be connected while keeping adequate softness.

(5) The knitted article according to any one of the items (1) to (4), wherein the first filament is a polyester-based elastomer.

According to such a configuration, with the polyester-based elastomer being included, the knitted article is more excellent in abrasion resistance.

EXAMPLES

Now, the present invention is described more in detail with Examples and Comparative examples. The present invention is not limited to those Examples. Each numerical value in Tables is on the basis of mass %.

A measurement method employed in the Examples is as follows.

<Fineness of First Filament (Single Yarn Fineness)>

A single yarn fineness was calculated by dividing a total fineness by the number of filaments.

<Fineness of Second Filament (Total Fineness)>

A total fineness was calculated by taking 25 second filaments from a knitted article, loosening them, and measuring their length (mm) and mass (mg) in accordance with JIS L 1018 (2010) 8.7.1.

<Number of Filaments>

The number of filaments was calculated according to the method in JIS L 1013 (1999) 8.4.

<Bending Stiffness of First Filament and Second Filament>

Figure 10:
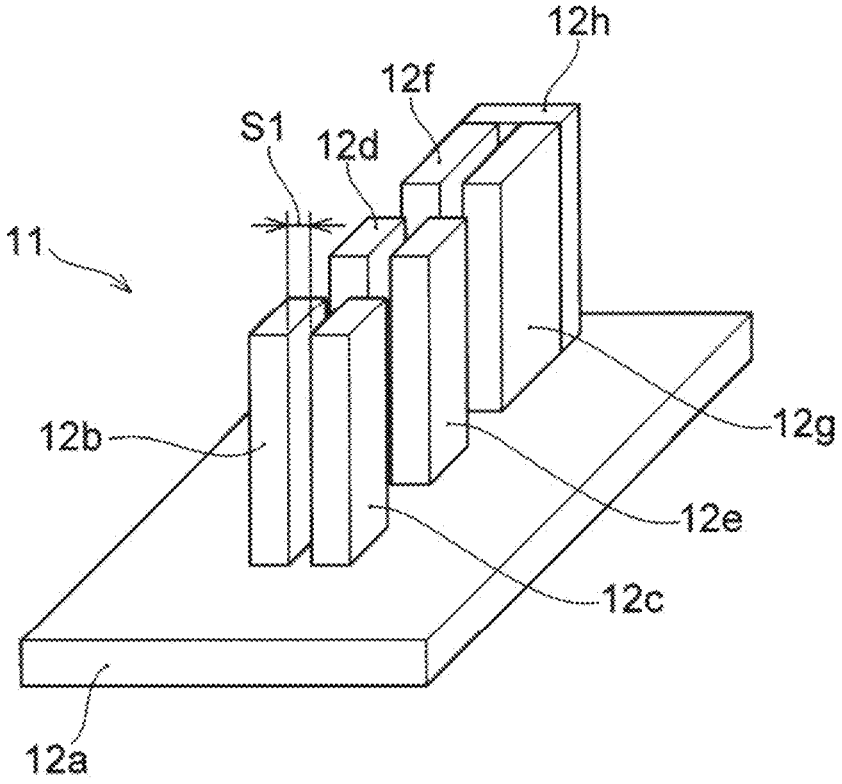
FIG. 10 is a schematic perspective view of a bending stiffness measurement jig.
Figure 11:
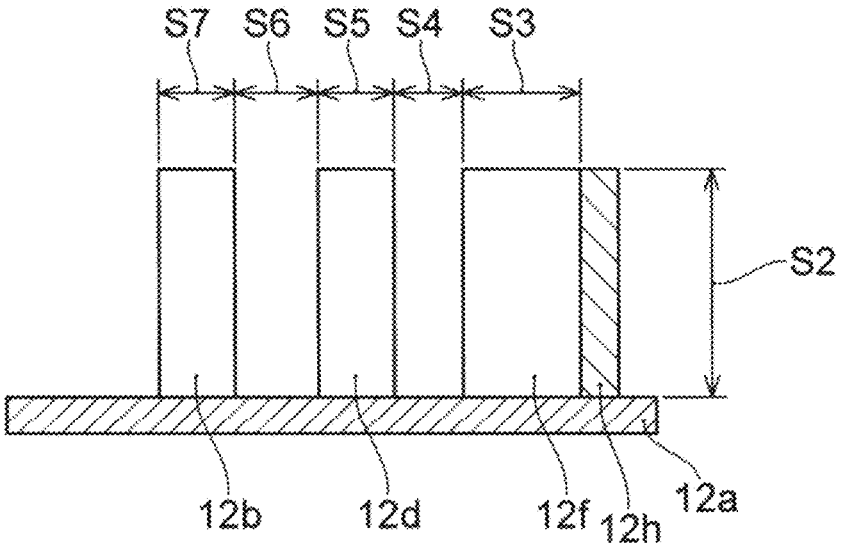
FIG. 11 is a schematic sectional view of the bending stiffness measurement jig.

From the knitted article, 10 strands each of the first filament and the second filament with a length of 120 mm or more were randomly taken. The respective filaments were cut to a length of 120 mm, and the 10 strands were grouped into a bundle. Portions 10 mm from both ends of the bundle were then bound with masking tape (product name: 243J Plus, seller: 3M Japan Limited). FIG. 10 is a schematic perspective view of a bending stiffness measurement jig 11. FIG. 11 is a schematic sectional view of the bending stiffness measurement jig 11. The bending stiffness measurement jig 11 includes a bottom plate 12*a* and 7 guide plates in total (12*b* to 12*h*) provided upright on the bottom plate. The bending stiffness measurement jig 11 is a jig for measuring the load required to deform a bundle of filaments into a predetermined shape by pushing a distal end portion 14 of a digital force gauge against the bundle under a state in which the bundle of filaments is fixed by 3 stainless steel rods 13 (having a diameter of 10 mm). Dimensions and separation distances of the guide plates in the measurement jig 11, arrangements S1 to S9 (see also FIG. 14), and a separation distance S10 between the distal end portion and a substrate given when the distal end portion of the digital force gauge is pushed against the bundle (see also FIG. 14), are as follows.

S1: 3 mm
S2: 30.0 mm
S3: 15.5 mm
S4: 9.0 mm
S5: 10.0 mm
S6: 11.0 mm
S7: 10.0 mm
S8: 20.0 mm
S9: 40.0 mm
S10: 10.0 mm

Figure 12:
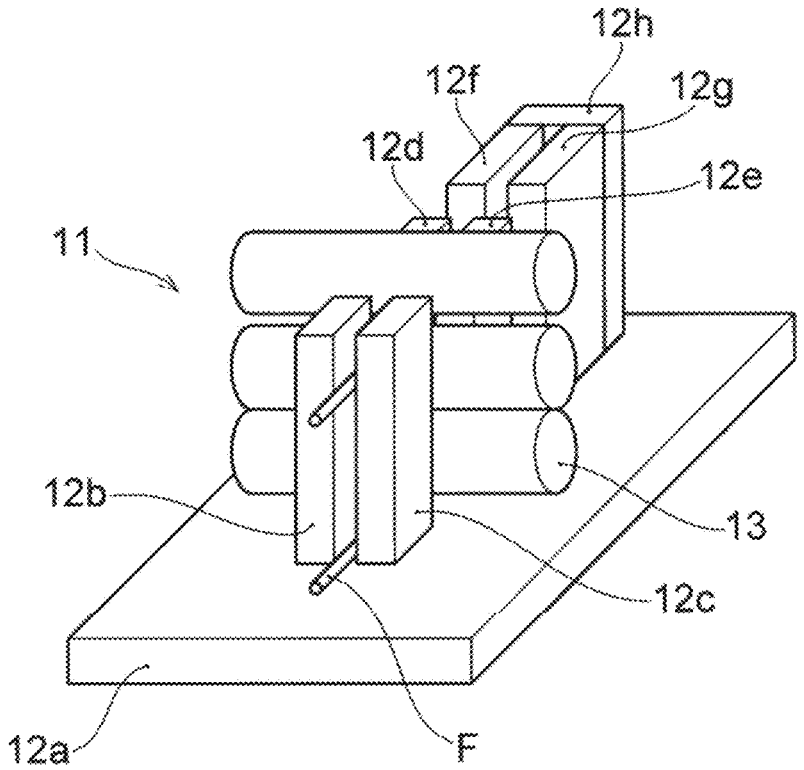
FIG. 12 is a schematic perspective view for illustrating a state in which a bundle of filaments is mounted to the bending stiffness measurement jig.
Figure 13:
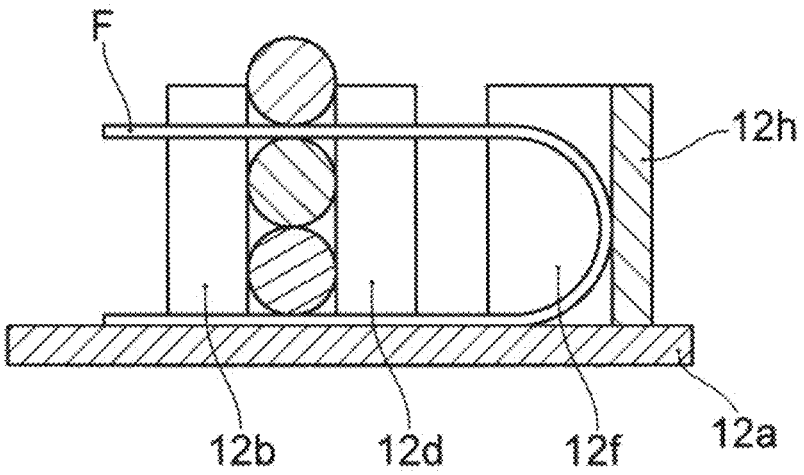
FIG. 13 is a schematic sectional view for illustrating the state in which the bundle of filaments is mounted to the bending stiffness measurement jig.
Figure 14:
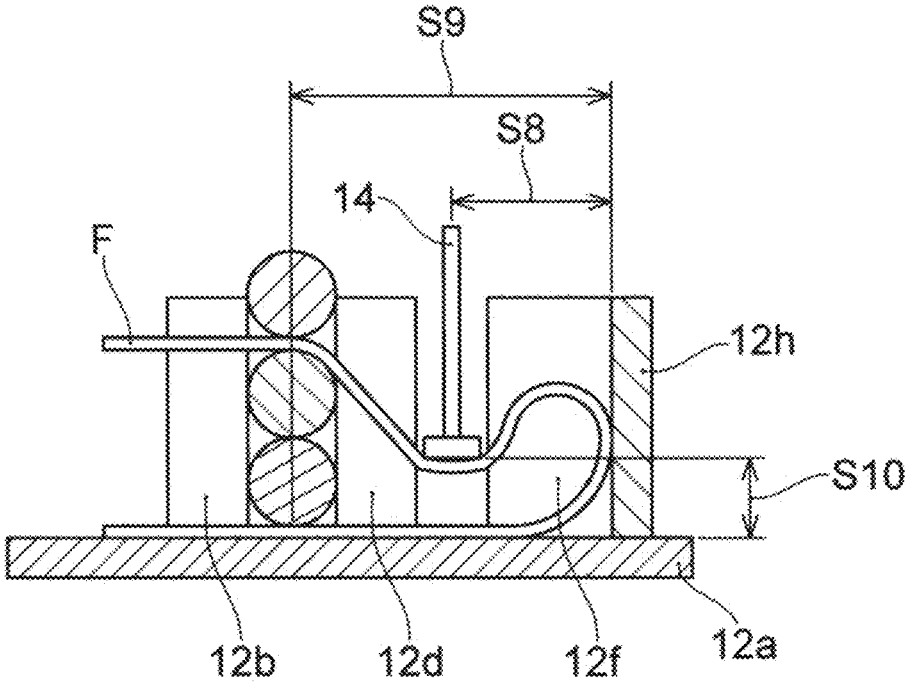
FIG. 14 is a schematic sectional view for illustrating a state in which a distal end portion of a digital force gauge is pushed against the bundle of filaments set on the bending stiffness measurement jig.

FIG. 12 is a schematic perspective view for illustrating a state in which a bundle of filaments F is mounted to the bending stiffness measurement jig 11. FIG. 13 is a schematic sectional view for illustrating a state in which the bundle of filaments F is mounted to the bending stiffness measurement jig 11. As illustrated in FIG. 12 and FIG. 13, the bundle of filaments F is placed in gaps of the guide plates (a gap between the guide plate 12*b* and the guide plate 12*c*, a gap between the guide plate 12*d* and the guide plate 12*e*, and a gap between the guide plate 12*f* and the guide plate 12*g*), and is folded back in a U-shape such that the distal end abuts against the guide plate 12*h*. FIG. 14 is a schematic sectional view for illustrating a state in which the distal end portion 14 of the digital force gauge is pushed against the bundle of filaments F set on the bending stiffness measurement jig 11. For transition from the state illustrated in FIG. 13 to the state illustrated in FIG. 14, the filament F was pushed downward at a speed of 100 mm/min with a digital force gauge (product name: FGP-0.5, seller: Nidec-Shimpo Corportation, not shown) that had an extension rod and a flat-shaped attachment (having a diameter of 8.0 mm) supplied with the device attached to the distal end portion 14, and the load given at that time was determined. The above measurement was repeated 5 times, and an average value was taken as the bending stiffness of the filament.

<Proportion of Second Filament Per Unit Area on One Surface in Top View>

It was calculated by performing image processing on an SEM photograph of one surface of the knitted article. Specifically, using a scanning electron microscope (product name: SU-3800, seller: Hitachi High-Tech Corporation), a secondary electron image of 1280×960 pixels was captured with an accelerating voltage of 1 kV, a working distance of 20 mm, and a magnification of 20×. After performing binarization processing, area aggregation was performed to determine proportions of the first filament and the second filament in the image. Subsequently, using the same secondary electron image, opening (erosion/dilation) processing was performed with a 15-pixel condition after the binarization processing, and the second filament thinner than the first filament was excluded from the processed image. After that, area aggregation was performed, and the later-determined total area proportion of the first filament was subtracted from the previously-determined total area proportion of the first filament and the second filament to calculate the proportion of the second filament in top view. The above measurement was performed on 20 samples randomly taken from the knitted fabric, for both one surface and its opposite surface, and an average value for each surface was taken as the proportion of the second filament per unit area on one surface in top view.

<Proportion of the First Filament Among all the Filaments Constituting the Cutting Line a Parallel to the Knitted Article Surface at the Depth of 20 μm in the Thickness Direction from the Knitted Article Surface in the Cross Section Taken Along the Thickness Direction, and Proportion of the Second Filament Among all the Filaments Constituting the Cutting Line B Parallel to the Knitted Article Surface at the Position Deeper by 100 μm from the Cutting Line A>

On a release surface of a silicone release film (product name: #38 Cerapeel (registered trademark) WZ, seller: Toray Advanced Film Co., Ltd.), 1 g each of an agent A and an agent B of an epoxy resin (product name: Bond Quick (registered trademark) 5, seller: KONISHI Co., Ltd.) were squeezed out, 0.04 g of a titanium oxide pigment (product name: TIPAQUE R-930, seller: Ishihara Sangyo Kaisha, Ltd.) was added, and the mixture was stirred for 30 seconds with a supplied spatula. Then, within one minute, a 20 mm square knitted fabric sample randomly taken from the knitted article was placed with the surface to be evaluated facing down onto the epoxy resin. The aforementioned silicone release film was placed on top, and the assembly was sandwiched between 3 mm thick float glass plates and then embedded and fixed for 45 minutes under a load of 2.5 kg. After that, the silicone release film was peeled off, and the central part of the knitted fabric was cut into a 10 mm square to obtain a resin-embedded sample. Next, this resin-embedded sample was sectioned with a microtome, its cross-section was cut out, and it was observed with a microscope. The surface of the resin-embedded sample prepared by this method was planar, and the surface of the resin-embedded sample in its cross-section was linear, as shown in FIG. 7.

<Proportion of Tuck Knitting>

Five samples were randomly taken from the knitted article and observed with a microscope. A proportion of tuck knitting was determined by dividing the number of tuck knitting per square inch by the total number of stitches.

<Abrasion Resistance (Weight Change)>

Two test pieces with a diameter of 38 mm were randomly taken from the knitted article. Next, based on the JIS L 1096 Method E (Martindale method), an abrasion test of 10,000 cycles was performed using a Martindale tester with a pressing load of 12 kPa. The weight of the test pieces was measured before and after the abrasion test, and the weight loss (mg) after the abrasion test was measured. Here, the "weight loss of the knitted article after abrasion" refers to an average value of the weight loss of the two test pieces. A two-grade judgment was made, where cases in which the calculated average value of weight loss after abrasion was 10 mg or less were rated as ○, and cases in which it was more than that were rated as x.

<Abrasion Resistance (Discoloration or Fading)>

The samples before and after the abrasion test were evaluated on a nine-grade scale from grade 5 to grade 1, using the gray scale for assessing discoloration or fading specified in JIS L 0804:2004.

Example 1

A first filament (monofilament) was prepared using "Hytrel" (registered trademark), a flame-retardant polyester-based elastomer, and the filament was black spun-dyed and had a single yarn fineness of 760 dtex. The bending stiffness of the first filament was 181 mN. Moreover, a second filament (multifilament) formed of polyethylene terephthalate (PET) fibers was prepared, and the filament was black spun-dyed and had a single yarn fineness of 3.5 dtex and a total fineness of 334 dtex. The bending stiffness of the second filament was less than 20 mN. Plating knitting was performed using the first filament and the second filament. For the plating knitting, a computerized flat knitting machine (product name: SSG122SC-12G, seller: SHIMA SEIKI MFG., LTD.) was used to perform plating knitting with two carriers. Moreover, programming and knitting adjustments were made so that the proportion of tuck knitting was 25%, thereby producing a knitted article of Example 1.

Example 2

A knitted article of Example 2 was produced in the same manner as in Example 1, except that the single yarn fineness of the first filament was changed to 610 dtex.

Example 3

A knitted article of Example 3 was produced in the same manner as in Example 1, except that the second filament was changed to a PET fiber having a single yarn fineness of 3.5 dtex and a total fineness of 660 dtex.

Example 4

A knitted article of Example 4 was produced in the same manner as in Example 1, except that programming and knitting adjustments were made so that the proportion of tuck knitting was 50%.

Example 5

A knitted article of Example 5 was produced in the same manner as in Example 1, except that programming and knitting adjustments were made so that the proportion of tuck knitting was 17%.

Example 6

A knitted article of Example 6 was produced in the same manner as in Example 1, except that programming and knitting adjustments were made so that the proportion of tuck knitting was 13%.

Comparative Example 1

A knitted article of Comparative example 1 was produced in the same manner as in Example 1, except that programming and knitting adjustments were made so that the proportion of tuck knitting was 0%, that is, no tucking was performed.

Comparative Example 2

A knitted article of Comparative example 2 was produced in the same manner as in Example 1, except that held-together yarn knitting was performed instead of plating knitting.

Comparative Example 3

A knitted article of Comparative example 3 was produced in the same manner as in Example 1, except that polyethylene terephthalate (PET, with a single yarn fineness of 3.5 dtex and a total fineness of 334 dtex) being a multifilament was used as both the first filament and the second filament.

Comparative Example 4

A knitted article of Comparative example 4 was produced in the same manner as in Example 1, except that programming and knitting adjustments were made so that the proportion of tuck knitting was 6%.

Comparative Example 5

A knitted article of Comparative example 5 was produced in the same manner as in Example 1, except that programming and knitting adjustments were made so that the proportion of tuck knitting was 3%.

Comparative Example 6

A knitted article of Comparative example 6 was produced in the same manner as in Example 1, except that programming and knitting adjustments were made so that the proportion of tuck knitting was 2%.

Comparative Example 7

A knitted article of Comparative example 7 was produced in the same manner as in Example 1, except that programming and knitting adjustments were made so that the proportion of tuck knitting was 1%.

For the knitted articles obtained in the above Examples 1 to 6 and Comparative examples 1 to 7, the following were evaluated: "proportion of the second filament per unit area on one surface in top view"; "proportion of the first filament among all the filaments constituting the cutting line A parallel to the knitted fabric surface at the depth of 20 μm in the thickness direction from the knitted fabric surface, in a cross section taken along the thickness direction, and, the proportion of the second filament among all the filaments constituting the cutting line B parallel to the knitted fabric surface at a position deeper by 100 μm than cutting line A"; "abrasion resistance (weight change)"; and "abrasion resistance (discoloration or fading)". The results are shown in Tables 1 and 2.

TABLE 1

| | Unit | Example 1 | Example 2 | Example 3 | Example 4 | Example 5 | Example 6 |
|---|---|---|---|---|---|---|---|
| First filament | | | | | | | |
| Form | | Monofilament | Monofilament | Monofilament | Monofilam | Monofilam | Monofilam |
| Material | | Polyester-based elastomer | Polyester-based elastomer | Polyester-based elastomer | Polyester-based elastom | Polyester-based elastom | Polyester-based elastom |
| Fineness | dtex | 760 | 610 | 770 | 760 | 760 | 765 |
| Bending stiffness | mN | 181 | 80 | 185 | 183 | 181 | 181 |
| Second filament | | | | | | | |
| Form | | Multifilament | Multifilament | Multifilament | Multifilament | Multifilament | Multifilament |
| Material | | PET | PET | PET | PET | PET | PET |
| Fineness | dtex | 334 | 334 | 660 | 350 | 330 | 334 |
| Bending stiffness | mN | Less than 20 | Less than 20 | Less than 20 | Less than 20 | Less than 20 | Less than 20 |
| Knittted fabric | | | | | | | |
| Plating knitting | | Present | Present | Present | Present | Present | Present |
| Proportion of tuck knitting | % | 25 | 25 | 25 | 50 | 17 | 13 |
| Proportion of second filament | % | 25 | 29 | 43 | 21 | 27 | 35 |

TABLE 1-continued

| | Unit | Example 1 | Example 2 | Example 3 | Example 4 | Example 5 | Example 6 |
|---|---|---|---|---|---|---|---|
| Proportion of first filament at cutting line A | % | 100 | 98 | 97 | 98 | 95 | 91 |
| Proportion of second filament at cutting line B | % | 24 | 30 | 25 | 20 | 20 | 35 |
| Bending stiffness of first filament/ bending stiffness of second filament | Times | 9.1 or more | 4 or more | 9.1 or more | 9.1 or more | 9.1 or more | 9.1 or more |
| Abrastion resistance (Martindale) | | | | | | | |
| Weight change | <10 mg | ○ | ○ | ○ | ○ | ○ | ○ |
| Discoloration or fading | Grade | 4 to 5 | 4 | 3 to 4 | 4 to 5 | 4 to 5 | 4 to 5 |

TABLE 2

| | Unit | Comparative example 1 | Comparative example 2 | Comparative example 3 | Comparative example 4 |
|---|---|---|---|---|---|
| First Filament | | | | | |
| Form | | Monofilament | Monofilament | Monofilament | Monofilament |
| Material | | Polyester-based elastomer | Polyester-based elastomer | PET | Polyester-based elastomer |
| Fineness | dtex | 760 | 760 | 334 | 765 |
| Bending stiffness | mN | 181 | 181 | Less than 20 | 185 |
| Second filament | | | | | |
| Form | | Multifilament | Multifilament | Multifilament | Multifilament |
| Material | | PET | PET | PET | PET |
| Fineness | dtex | 334 | 334 | 334 | 334 |
| Bending stiffness | mN | Less than 20 | Less than 20 | Less than 20 | Less than 20 |
| Knitted fabric | | | | | |
| Plating knitting | | Present | Absent | Present | Present |
| Proportion of tuck knitting | % | 0 | 0 | 25 | 6 |
| Proportion of second filament | % | 73 | 62 | 80 | 70 |
| Proportion of first filament of cutting line A | % | 10 | 55 | — | 20 |
| Proportion of second filament of cutting line B | % | 20 | 48 | — | 70 |
| Bending stiffness of first filament/bending stiffness of second filament | Times | 9.1 or more | 9.1 or more | 1 | 9.1 or more |
| Abrasion resistance (Martindale) | | | | | |
| Weight change | <10 mg | ○ | ○ | x | ○ |
| Discoloration or fading | Grade | 2 | 2 to 3 | 2 | 3 |

| | Unit | Comparative example 5 | Comparative example 6 | Comparative example 7 |
|---|---|---|---|---|
| First filament | | | | |
| Form | | Monofilament | Monofilament | Monofilament |
| Material | | Polyester-based elastomer | Polyester-based elastomer | Polyester-based elastomer |
| Fineness | dtex | 763 | 773 | 764 |
| Bending stiffness | mN | 185 | 181 | 181 |
| Second filament | | | | |
| Form | | Multifilament | Multifilament | Multifilament |
| Material | | PET | PET | PET |
| Fineness | dtex | 334 | 334 | 334 |
| Bending stiffness | mN | Less than 20 | Less than 20 | Less than 20 |

TABLE 2-continued

| Knitted fabric | | | | |
|---|---|---|---|---|
| Plating knitting | | Present | Present | Present |
| Proportion of tuck knitting | % | 3 | 2 | 1 |
| Proportion of second filament | % | 70 | 75 | 80 |
| Proportion of first filament at cutting line A | % | 15 | 15 | 10 |
| Proportion of second filament at cutting line B | % | 73 | 80 | 83 |
| Bending stiffness of first filament/bending stiffness of second filament | Times | 9.1 or more | 9.1 or more | 9.1 or more |
| Abrasion resistance (Martindale) | | | | |
| Weight change | <10 mg | ○ | ○ | ○ |
| Discoloration or fading | Grade | 2 to 3 | 2 to 3 | 2 to 3 |

As shown in Table 1, the knitted articles of Examples 1 to 6 of the present invention had a small weight change after the abrasion resistance test and was excellent in superior abrasion resistance. Moreover, for the knitted articles of Examples 1 to 6, the evaluation result for discoloration or fading was grade 3 to 4 or higher, and they were less liable to undergo discoloration or fading.

Among them, as shown in Tables 1 and 2, the knitted articles of Examples 1, 4, 5, and 6 of the present invention, when compared to the knitted articles of Comparative examples 4, 5, and 6, had a proportion of tuck knitting designed within an appropriate range, and in top view, the proportion of the second filament per unit area on one surface was from 10% to 50%, and in a cross-section taken along the thickness direction, among all the filaments constituting the cutting line A parallel to the knitted fabric surface at a depth of 20 μm from the knitted fabric surface, the first filament was 90% or more, resulting in even more excellent knitted article abrasion resistance.

REFERENCE SIGNS LIST

1, 1*a* knitted article
2 fiber debris
3 rubbing cloth
11 bending stiffness measurement jig
12*a* bottom plate
12*b* to 12*h* guide plate
13 stainless steel rod
14 distal end portion
A, B cutting line
F bundle of filaments
F1 first filament
F2 second filament
L1 line indicating a depth of 20 μm
L2 line indicating a depth of 100 μm
Sa knitted article surface
Sb resin-embedded sample surface

The invention claimed is:

1. A knitted article comprising a first filament and a second filament interknitted together, wherein a fineness of the second filament is smaller than a fineness of the first filament, wherein, in top view, a proportion of the second filament per unit area on one surface is from 10% to 50%, and wherein, in a cross section taken along a thickness direction, among all the filaments constituting a cutting line A parallel to the knitted article surface at a depth of 20 μm in the thickness direction from the knitted article surface, the first filament is 90% or more.

2. The knitted article according to claim 1, wherein the first filament is a monofilament, and wherein the second filament is a multifilament.

3. The knitted article according to claim 1, wherein, in the cross section taken along the thickness direction, among all the filaments constituting a cutting line B parallel to the knitted article surface at a position deeper by 100 μm in the thickness direction from the cutting line A, the second filament is from 15% to 50%.

4. The knitted article according to claim 1, wherein, in the cross section of the knitted article taken along the thickness direction, among all the filaments constituting the cutting line A parallel to the knitted article surface at the depth of 20 μm in the thickness direction from the knitted article surface, in a surface in which the first filament accounts for 90% or more, tuck knitting accounts for 10% or more of stitches per unit area, and wherein a bending hardness of the first filament is at least twice a bending hardness of the second filament.

5. The knitted article according to claim 1, wherein the first filament is a polyester-based elastomer.

* * * * *